US008256889B1

(12) United States Patent
Abbott et al.

(10) Patent No.: US 8,256,889 B1
(45) Date of Patent: Sep. 4, 2012

(54) PLATEN FOR DIGITAL PRINTING ON VARIABLE HEIGHT GARMENTS

(75) Inventors: Michael D. Abbott, Statesville, NC (US); Dean Craver, King, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 556 days.

(21) Appl. No.: 12/412,412

(22) Filed: Mar. 27, 2009

(51) Int. Cl.
*B41J 2/01* (2006.01)
*B41J 21/00* (2006.01)
*B05C 17/06* (2006.01)

(52) U.S. Cl. ..... 347/104; 347/101; 101/126; 101/474

(58) Field of Classification Search ..... 347/4, 101, 347/104; 101/41, 126, 474; 400/41, 48, 400/648

See application file for complete search history.

(56) References Cited

U.S. PATENT DOCUMENTS

| | | | | |
|---|---|---|---|---|
| 4,841,306 | A | 6/1989 | Archer et al. | |
| 4,846,058 | A | 7/1989 | Farris | |
| 5,467,973 | A | 11/1995 | Graushar et al. | |
| 5,673,621 | A | 10/1997 | Vaughan | |
| 6,059,391 | A | 5/2000 | Fulkerson et al. | |
| 6,631,985 | B2 * | 10/2003 | Koizumi et al. | 347/101 |
| 6,640,714 | B1 | 11/2003 | Papa | |
| 6,755,494 | B2 | 6/2004 | Park | |
| 6,908,190 | B2 * | 6/2005 | Iwatsuki et al. | 347/104 |
| 7,413,301 | B2 | 8/2008 | Niimi et al. | |
| 7,765,927 | B1 * | 8/2010 | Liu et al. | 101/474 |
| 2005/0179708 | A1 | 8/2005 | Ben-Zur | |
| 2006/0249039 | A1 | 11/2006 | Feldman et al. | |
| 2007/0103529 | A1 | 5/2007 | Pearl et al. | |
| 2008/0196836 | A1 * | 8/2008 | Woods | 156/367 |
| 2009/0090257 | A1 | 4/2009 | Feldman et al. | |

OTHER PUBLICATIONS

Paul J. Borucki, Direct Digital Printing for Garments, SGIA Journal, Third Quarter 2005, pp. 15-17.
Kornit Digital Ltd., Kornit 93X Direct-on-Garment Digital Printing User's Guide, Jan. 2006.

* cited by examiner

*Primary Examiner* — Matthew Luu
*Assistant Examiner* — Jannelle M Lebron
(74) *Attorney, Agent, or Firm* — Womble Carlyle Sandridge & Rice, LLP

(57) ABSTRACT

Platens for digital garment printing are provided. The platens include cutouts or depressions configured to conform to areas of increased height on garments. The garments may then be placed onto the platens such that the garments have a substantially uniform horizontal printing surface, thus providing high quality printing on the garments.

16 Claims, 6 Drawing Sheets

PLATEN FOR DIGITAL PRINTING ON VARIABLE HEIGHT GARMENTS

BACKGROUND

Digital printing machines may include platens, or pallets, on which items to be printed, such as garments or other textiles, are positioned for printing. Examples of such printing machines are the machines manufactured by Kornit Digital, Ltd.

The conventional platens used in known digital printing machines are formed as substantially flat beds, i.e., having a substantially horizontal upper surface area. These conventional platens provide acceptable results when used for printing on items, such as T-shirts, that have substantially uniform horizontal surface areas. However, conventional direct on-garment digital printing machines, on which the print heads and platen are vertically fixed with respect to each other, tend to produce unacceptable print quality when printing on garments, such as golf shirts, that have raised portions, such as plackets, collars, hems, or pockets. This is due at least in part to the fact that the print heads are positioned at a fixed height above the surface of the garment.

FIGS. 1 and 2 illustrate an example of a conventional digital printing machine 1 having a print head 2 and a platen 4 having a top printing surface 5. The print head 2 is positioned at a fixed vertical position relative to the platen 4, and includes one or more nozzles 2*a* configured to spray ink 3 to print a design or image on an outer surface of a textile or garment 6. By "fixed vertical position", we mean that the print head 2 does not move in vertical direction relative to the platen 4. The upper surface 5 is substantially flat (horizontal) with no deviation in surface height. As shown in FIG. 1, the surface 5 supports the textile or garment 6 such that the textile or garment 6 has a substantially uniform thickness or height, T. Thus, the garment has a uniform horizontal printing surface 9, which receives a substantially uniform ink spray pattern P from the nozzle 2*a*.

In FIG. 2, the platen 4 supports a textile or garment 8 having a variable thickness or height. Specifically, the garment 8 includes a first area 8*a* having a height $T_a$, and a second, raised area 8*b* having a height $T_b$ that is greater than the height $T_a$. As can be seen in FIG. 2, the raised area 8*b* causes the garment 8 to have a non-uniform horizontal printing surface 9*a*, which in turn results in an irregular spray pattern $P_1$ from the nozzle 2*a*. As will be appreciated, the irregularity in the spray pattern $P_1$ diminishes the quality of the design or image printed on the garment 8.

Some known printing machines address the problem of printing on variable height garments by providing mechanisms for adjusting either the vertical position of the platen or the vertical position of the print heads when there is a variation in the height of a particular article. However, providing such vertical position adjustment mechanisms can add significant complexity and expense to printing machines.

In view of the above, it is desirable to provide a simple, cost-effective solution for digitally printing on garments of variable height with printing machines having vertically-fixed print heads.

SUMMARY

One object of the present invention is to provide platens for digital printing on garments or other textiles of variable height, such as shirts having pockets and/or raised plackets. A platen according to the invention includes one or more cutouts, depressions, or protrusions that substantially conform to the position and height of vertically raised areas on the textile or garment to be printed.

According to one embodiment, a platen may include a cutout or depression having dimensions that conform to a placket of a garment. According to another embodiment, a platen may include a cutout or depression having dimensions that conform to a pocket of a garment. In another embodiment, a platen may include a cutout or depression having dimensions that conform to a collar of a garment. In yet another embodiment, the platen may include a cutout or depression that has dimensions that conform to a hem of a garment. Further embodiments may include multiple cutouts or depressions, wherein each of the cutouts or depressions has dimensions that conform to a raised portion, such as, a placket, pocket, collar, or hem of a garment.

Further features and advantages of the invention will be apparent upon reference to the following description, appended drawings and claims.

DETAILED DESCRIPTION

The following description and FIGS. 3A through 7B describe several exemplary embodiments of platens for use in digitally printing on variable height garments. Each of the platens described herein includes one or more cutouts or depressions, which accommodate the variable height of the garment to be positioned thereon for printing, thereby providing high quality, uniform printing. As used herein, "depression" refers to an area lower than the surrounding or adjacent area, which may extend completely either partially or completely through the platen, wherein "cutout" more specifically refers to a form of depression, which is formed along the outer periphery of the platen. These terms, however, my be used interchangeably.

Figure 1:
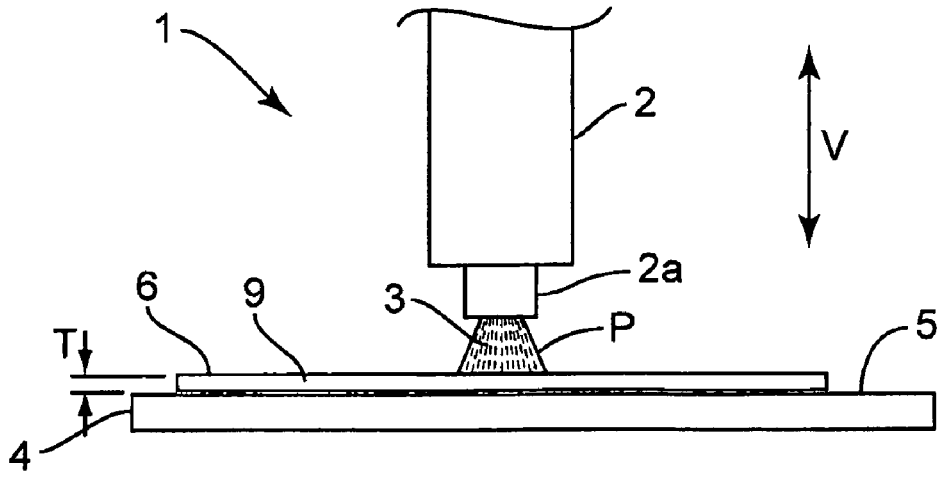
FIG. 1 PRIOR ART
FIG. 1 illustrates a digital printing machine including a conventional platen for positioning garments for printing, wherein the machine is printing on a garment having a substantially uniform height.
Figure 2:
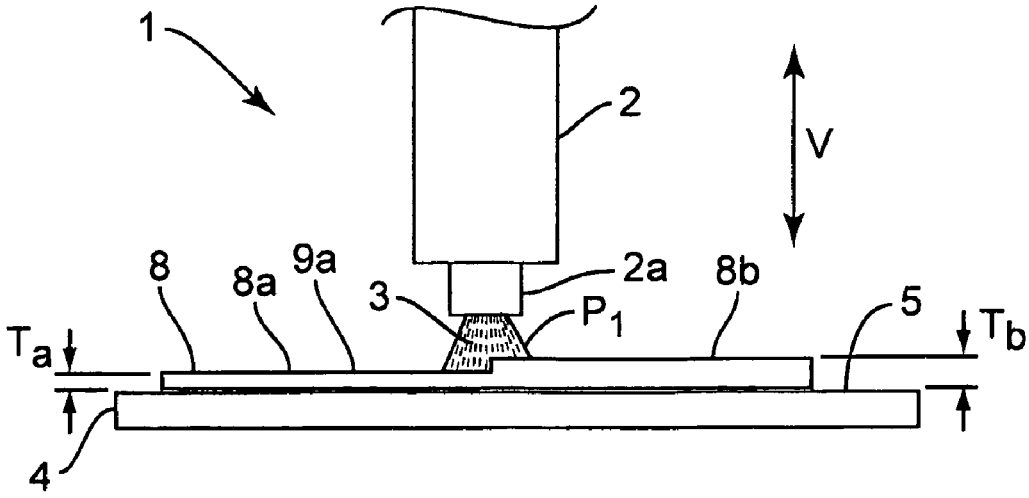
FIG. 2 PRIOR ART
FIG. 2 illustrates the digital printing machine of FIG. 1, wherein the machine is printing on a garment having a variable height.
Figure 3A:
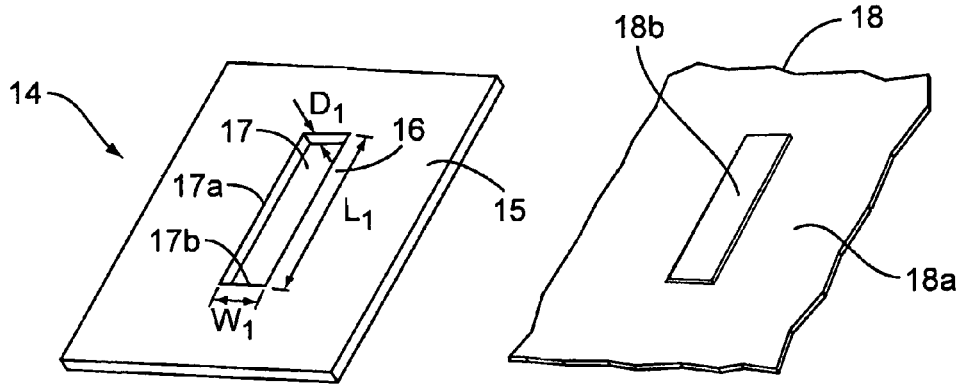
FIG. 3A shows a variable height platen and a garment for placement on the platen according to one embodiment of the invention.
Figure 3B:
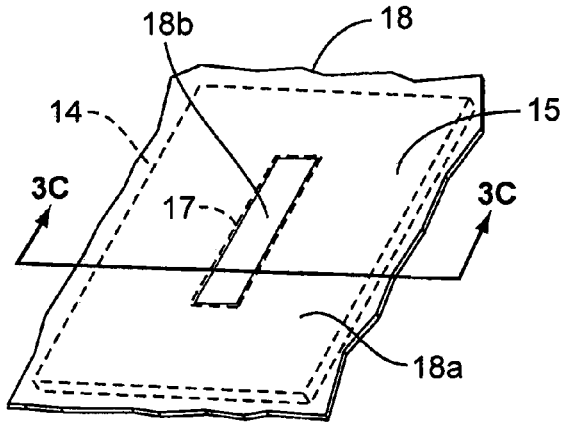
FIG. 3B shows the platen and garment of FIG. 3A with the raised area of the garment positioned in the depression in the platen for printing.
Figure 3C:
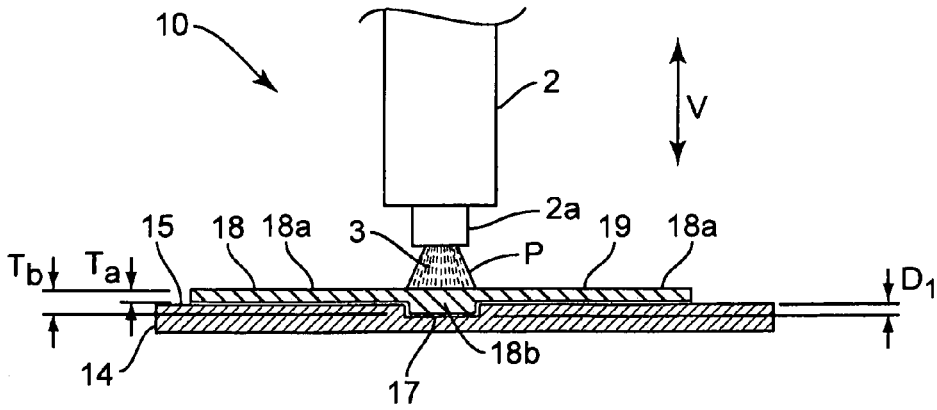
FIG. 3C is a cross-sectional view taken along line 3C-3C of FIG. 3B

FIGS. 3A through 3C shows a digital printing machine 10 including a variable height platen 14 according to one embodiment of the invention. The platen 14 includes a top surface 15. A variable height textile 18 is positioned over the top surface 15 of the platen 14 to be printed on by a print head 2. The textile 18 is considered to have a variable height because it includes first portions 18*a* having a first thickness, or height $T_a$ (in the vertical direction V of the machine 10) and a second, thicker portion 18*b* having a second height $T_b$ (in the vertical direction V of the machine 10) that is greater than the first height $T_a$. The platen 14 includes an area of reduced thickness or height in the form of a cutout or depression 17 having an upper surface that is located below the top surface 15.

The depression 17 is positioned and dimensioned to conform to the thicker portion 18*b* of the garment 18. As will be appreciated, the thicker portion 18*b* would typically be a raised portion on the garment if not for the depression 17, which accommodates the increased thickness. More specifically, the depression 17 is positioned to be aligned with the portion 18*b* when the garment 18 is placed over the platen 14, and has a length $L_1$, width $W_1$ and depth $D_1$ substantially similar to, or slightly larger than, the length, width, and height, respectively, of the portion 18*b*. The edges 17*a* of the depression 17 may be rounded or radiused to provide a smooth transition between the depression 17 and the surrounding area of the top surface 15 of the platen 14.

As shown in FIGS. 3A through 3C, the raised portion 18*b* of the garment is fitted in the depression 17 such that the thicker portion 18*b* does not protrude above the portion 18*a* in the vertical direction V of the machine 10. The machine 10 may include a manual or automated tool or mechanism (not shown) for forcing the thicker portion 18*b* into the depression 17. Bunching of the textile 18 in the area around the depression 17 is minimized by the rounded or radiused edges 17*a*. Thus, platen 14 is configured to conform to the three-dimensional surface profile of the garment 18, and the garment 18 is arranged to have a substantially uniform horizontal printing surface 19. The surface 19 therefore has substantially uniform vertical spacing with respect to the nozzle 2*a* of the print head 2. As a result, the nozzle 2*a* is able to spray ink 3 onto the outer surface 19 of the garment 18 in a substantially uniform ink spray pattern P, resulting in high quality printing across the entire surface area to be sprayed.

To print on the garment 18, one simply places the garment 18 on the platen 14 with the raised portions 18*b* being received by depression 17, secures the garment 18 on the platen 14, presents the garment to the print head, and operates the print head 2 to spray ink 3 on the surface 19 of the garment 18. The garment may be secured on the platen 14 by placing the garment on the platen or wrapping the garment 18 around the platen (depending on the configuration of the garment 18), and subsequently inserting the raised portion 18*b* into the depression 17.

FIGS. 4A through 4C, 5A through 5C, 6A through 6C, 7A and 7B illustrate additional exemplary embodiments of the present invention, including variable height platens and exemplary garments, such as shirts, to be printed thereon. The platens and shirts described in these embodiments may be employed in the machine 10 of FIG. 3 in the same manner and in the same orientation as the platen 14 and garment 18 shown in FIGS. 3A through 3C.

Figure 4A:
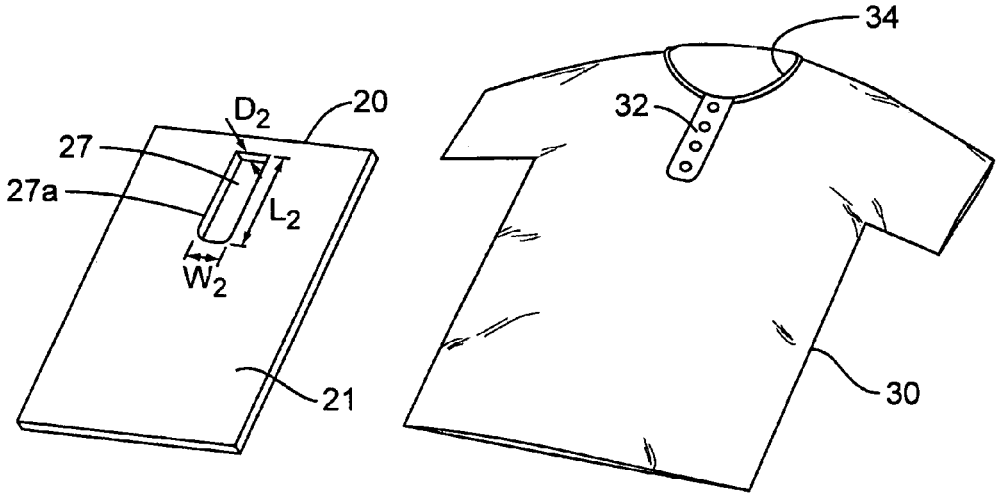
FIG. 4A shows a variable height platen and a shirt for placement on the platen according to another embodiment of the invention.
Figure 4B:
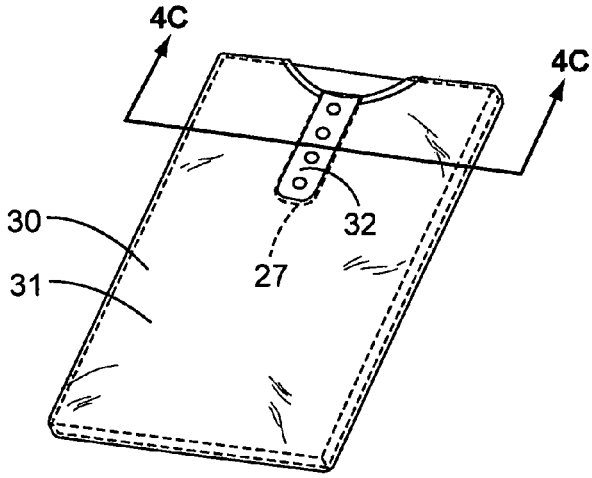
FIG. 4B shows the platen and shirt of FIG. 4A with the shirt placket positioned in the depression in the platen for printing.
Figure 4C:
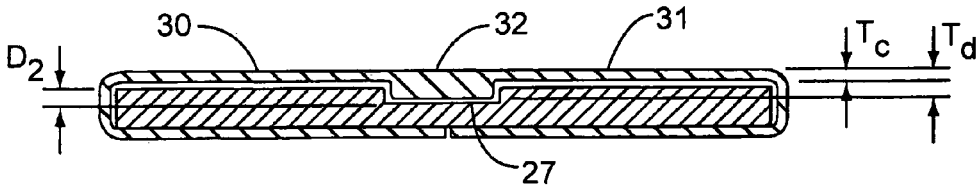
FIG. 4C is a cross-sectional view taken along line 4C-4C of FIG. 4B.

FIGS. 4A through 4C show a platen 20 configured to hold a button-up shirt 30 including a placket region 32 extending downwardly from a neck 34 of the shirt 30. The platen 20 includes a top surface 21. The shirt 30 has a variable height due to the placket 32 having a thickness, or height $T_d$ that is greater than the height $T_c$ of the adjacent portions of the main shirt body. The platen 20 includes an area of reduced height in the form of a cutout or depression 27 in the general shape of the placket 32.

The depression 27 is positioned to be aligned with the placket 32 when the shirt 30 is placed over the platen 20, and has a length $L_2$, width $W_2$ and depth $D_2$ substantially similar to, or slightly greater than the length, width, and height, respectively, of the placket 32. The edges 27*a* of the depression 27 may be rounded or radiused to provide a smooth transition between the depression 27 and the surrounding area of the top surface 21 of the platen 20.

As shown in FIGS. 4B and 4C, the shirt 30 is placed over the platen 20 such that the placket 32 is fitted in the depression 27 and does not protrude above the remainder of the shirt 30. Bunching of the shirt 30 in the area around the depression 27 is minimized by the rounded or radiused edges 27*a*. Therefore, the platen 20 is configured to conform to the three-dimensional surface profile of the shirt 30, and the shirt 30 is arranged to have a substantially uniform horizontal printing surface 31 over the platen 20, thus ensuring a higher quality digital print.

Figure 5A:
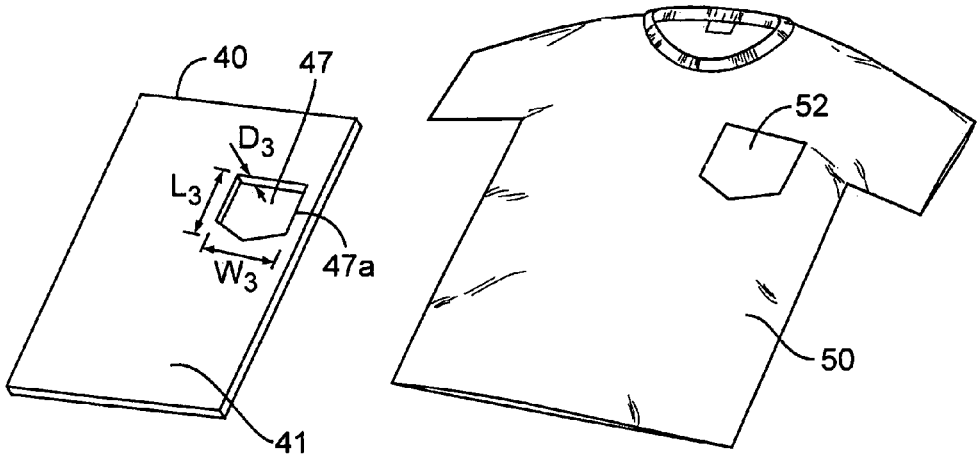
FIG. 5A shows a variable height platen and a shirt for placement on the platen according to another embodiment of the invention.
Figure 5B:
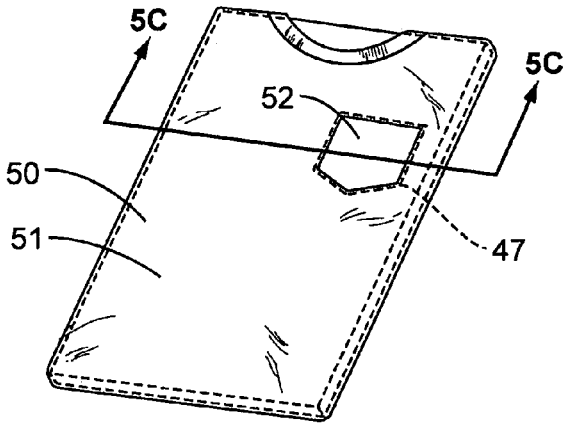
FIG. 5B shows the platen and shirt of FIG. 5A with the shirt pocket positioned in the depression in the platen for printing.
Figure 5C:
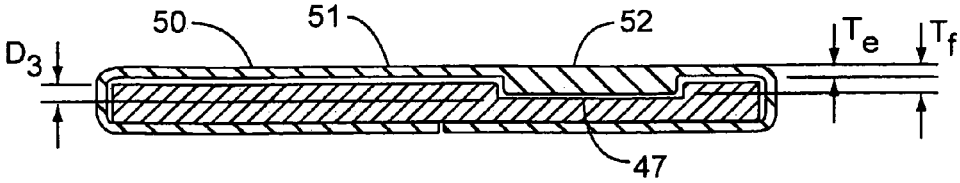
FIG. 5C is a cross-sectional view taken along line 5C-5C of FIG. 5B.

FIGS. 5A through 5C show a platen 40 configured to hold a shirt 50 including a pocket 52. The platen includes a top surface 41. The pocket 52 has a thickness, or height $T_f$ that is greater than the height $T_e$ of the surrounding portions of the main shirt body. The platen 40 includes a cutout or depression 47 in the general shape of the shirt pocket 52.

The depression 47 is positioned to be aligned with the pocket 52 when the shirt 50 is placed over the platen 40, and has a length $L_3$, width $W_3$ and depth $D_3$ substantially similar to, or slightly greater than the length, and height, respectively, of the pocket 52. The edges 47*a* of the depression 47 again may be rounded or radiused to provide a smooth transition between the depression 47 and the surrounding area of the top surface 41 of the platen 40.

As shown in FIGS. 5B and 5C, the shirt 50 is placed over the platen 40 such that the pocket 52 is fitted in the depression 47 and does not protrude above the remainder of the shirt 50. Bunching of the shirt 50 in the area around the depression 47 is minimized by the rounded or radiused edges 47*a*. Accordingly, the platen 40 conforms to the three-dimensional surface profile of the shirt 50. Again, the shirt 50 is arranged to have a substantially uniform horizontal outer surface 51 over the platen 40.

Figure 6A:
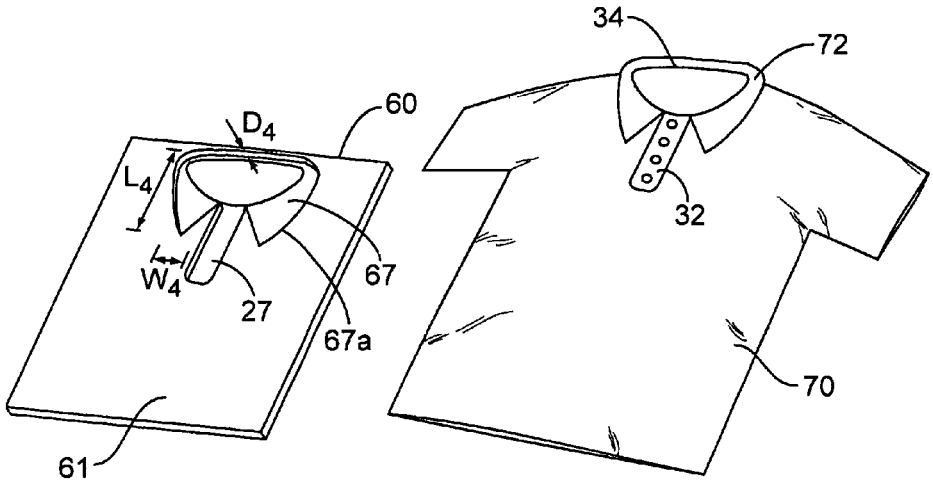
FIG. 6A shows a variable height platen and a shirt for placement on the platen according to another embodiment of the invention.
Figure 6B:
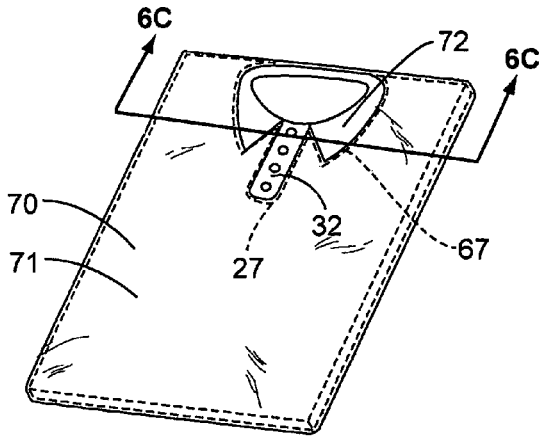
FIG. 6B shows the platen and shirt of FIG. 5A with the shirt collar and placket positioned in the depression in the platen for printing.
Figure 6C:
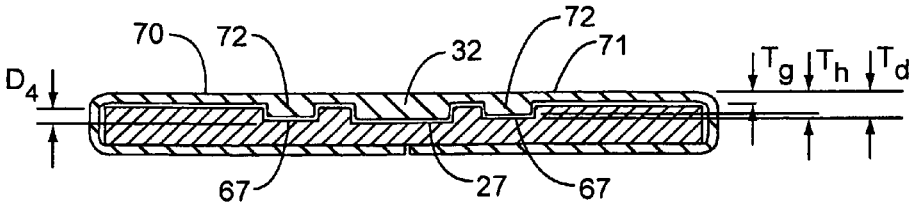
FIG. 6C is a cross-sectional view taken along line 6C-6C of FIG. 6B.

FIGS. 6A through 6C show a platen 60 configured to hold a shirt 70 including both a collar 72 and a placket 32. The shirt 70 has a variable height due to the collar 72 and placket 32 having thicknesses, or heights $T_h$, $T_d$ that are greater than the height $T_g$ of the surrounding portions of the main shirt body. The platen 60 includes a top surface 61, and depressions 67, 27 in the general shapes of a collar and placket.

The depression or cutout 27 is configured to conform to the placket 32, as described above. The depression or cutout 67 is positioned and dimensioned to conform to the collar 72. That is, the depression or cutout 67 is positioned to be aligned with the collar 72 when the shirt 70 is placed over the platen 60, and has a length $L_4$, width $W_4$ and depth $D_4$ substantially similar to, or slightly greater than the length, width, and height, respectively, of the collar 72. The edges 67*a* of the depression or cutout 67 may be rounded or radiused to provide a smooth transition between the depression or cutout 67 and the surrounding area of the top surface 61 of the platen 60.

As shown in FIGS. 6B and 6C, the shirt 70 is placed over the platen 60 such that the collar 72 and placket 32 are fitted into the respective depressions or cutouts 67, 27, and the collar 72 and placket 32 do not protrude above the remainder of the shirt 70. Bunching of the shirt 70 in the area around the depression 67 is minimized by the rounded or radiused edges 67*a*. Thus, as in the previous embodiments, the platen 60 conforms to the three-dimensional surface profile of the shirt 70 so that the shirt 70 has a substantially uniform horizontal outer printing surface 71 for printing.

Figure 7A:
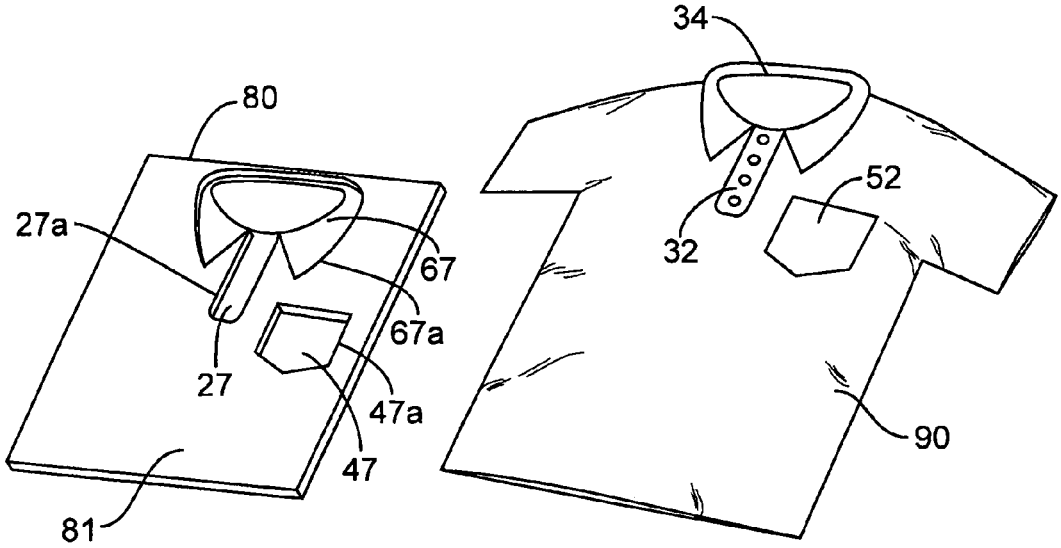
FIGS. 7A and 7B show a variable height platen according to another embodiment of the invention, wherein the platen includes depressions for printing on a shirt having a raised collar, placket, and pocket.
Figure 7B:
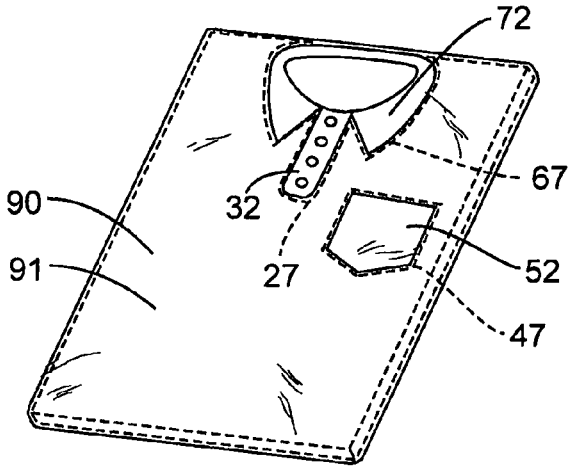

FIGS. 7A and 7B show yet another embodiment of the invention, including a platen 80 configured to hold a shirt 90 including a placket 32, a collar 72 and a pocket 52. The platen 80 includes a top surface 81, the depression 27 from the embodiment of FIGS. 4A through 4C, the depression 47 from the embodiment of FIGS. 5A through 5C and the depression 67 from the embodiment of FIGS. 6A through 6C. As shown in FIG. 7B, the shirt 90 may be placed over the platen 80 such that the placket 32, collar 72 and pocket 52 are fitted into the respective depressions or cutouts 27, 67, and 42 such that the shirt 90 has a substantially uniform horizontal outer surface 91 for printing.

Additionally, a platen according to the invention may include cutouts or depressions configured to receive any combination or type of textile portions of varying height such as, but not limited to, plackets, pockets, collars, and hems. Platens according to the invention can also be configured to hold many other types of textiles or garments such as, but not limited to pants, undergarments, towels, fabrics, etc.

The inventive platens may have a general thickness of about 0.25 inches or more to allow sufficient material for cutouts or depressions to be machined or worked into the platen without adversely affecting the structural integrity of the platen. As will be appreciated, the platens will be formed of a material that is strong but malleable, such that cutouts or depressions formed in the platen can be altered to accommodate different garments.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that this invention will include all embodiments falling within the scope of the present disclosure.

We claim:

1. A platen for digitally printing garments of selected types and shapes, comprising:

a top singular printing surface having at least one permanently preformed depression positioned and configured such that the depression substantially corresponds to a shape and height of an area of increased height of a garment portion, wherein when the area of increased height is fitted into the at least one depression, a substantially uniform horizontal garment surface is formed for printing thereon.

2. The platen of claim 1, wherein the top surface substantially conforms to the shape of the selected garment.

3. The platen of claim 1, wherein the at least one depression substantially corresponds to a garment portion selected from the group consisting of a placket, a pocket, a collar, a hem, and combinations thereof.

4. The platen of claim 1, wherein the at least one depression extends partially through the platen.

5. The platen of claim 1, wherein the at least one depression extends completely through the platen.

6. The platen of claim 1, wherein the at least one depression is formed within and surrounded by the top surface.

7. The platen of claim 1, wherein the top surface includes an outer periphery and the at least one depression is formed along the outer periphery.

8. A digital printer for a garment comprising:

a printing part having at least one nozzle; and a platen comprising a top singular printing surface having at least one permanently preformed depression positioned and configured such that the depression substantially corresponds to a shape and height of an area of increased height of a garment portion, wherein when the area of increased height is fitted into the at least one depression, a substantially uniform horizontal garment surface is formed for printing thereon.

9. The digital printer of claim 8, wherein the top surface substantially conforms to the shape of the selected garment.

10. The digital printer of claim 8, wherein said at least one depression substantially corresponds to a garment portion selected from the group consisting of a placket, a pocket, a collar, a hem, and combinations thereof.

11. The digital printer of claim 8, wherein the at least one depression extends partially through the platen.

12. The digital printer of claim 8, wherein the at least one depression extends completely through the platen.

13. The digital printer of claim 8, wherein the at least one depression is formed within and surrounded by the top surface.

14. The digital printer of claim 8, wherein the top surface includes an outer periphery and the at least one depression is formed along the outer periphery.

15. A method of digitally printing garments of selected types and shapes, comprising:

providing a platen comprising a top singular printing surface having at least one permanently preformed depression positioned and configured such that the depression substantially corresponds to a shape and height of an area of increased height of a garment portion;

placing the garment on the platen and positioning the area of increased height of the garment portion into the at least one depression such that a substantially uniform horizontal garment surface is formed for printing thereon; and printing the garment.

16. The method of claim 15, wherein the at least one depression substantially corresponds to at least one of a placket, a pocket, a collar, and a hem of said garment.

* * * * *